US009683359B2

(12) United States Patent
McAlpine

(10) Patent No.: US 9,683,359 B2
(45) Date of Patent: Jun. 20, 2017

(54) URINAL APPARATUS

(75) Inventor: James Kenneth McAlpine, Glasgow (GB)

(73) Assignee: MCALPINE & COMPANY LIMITED, Glasgow (GB)

( * ) Notice: Subject to any disclaimer, the term of this patent is extended or adjusted under 35 U.S.C. 154(b) by 661 days.

(21) Appl. No.: 12/679,755

(22) PCT Filed: Sep. 25, 2008

(86) PCT No.: PCT/GB2008/003239
§ 371 (c)(1),
(2), (4) Date: Mar. 24, 2010

(87) PCT Pub. No.: WO2009/040525
PCT Pub. Date: Apr. 2, 2009

(65) Prior Publication Data
US 2010/0199412 A1 Aug. 12, 2010

(30) Foreign Application Priority Data
Sep. 25, 2007 (GB) ..... 0718597.8

(51) Int. Cl.
*E03D 13/00* (2006.01)
*E03D 9/02* (2006.01)

(52) U.S. Cl.
CPC ..... *E03D 13/005* (2013.01); *E03D 2009/024* (2013.01)

(58) Field of Classification Search
USPC ..... 4/222, 222.1, 225.1, 227.1, 227.5
See application file for complete search history.

(56) References Cited

U.S. PATENT DOCUMENTS

| | | | | | |
|---|---|---|---|---|---|
| 556,692 | A * | 3/1896 | Purves | 96/119 |
| 877,309 | A * | 1/1908 | Emerson | 239/55 |
| 1,731,431 | A * | 10/1929 | Meyer | 4/222.1 |
| 1,880,962 | A * | 10/1932 | Koppelman | 4/309 |
| 4,103,367 | A * | 8/1978 | Kaufer | 4/222 |
| 4,546,503 | A * | 10/1985 | Casberg | C02F 1/688 222/190 |
| 5,489,415 | A * | 2/1996 | Van Vlahakis et al. | 422/264 |
| 5,987,655 | A | 11/1999 | Smet | |
| 6,151,722 | A * | 11/2000 | Lubrano | 4/225.1 |
| 2007/0186337 | A1* | 8/2007 | Emr | 4/309 |

FOREIGN PATENT DOCUMENTS

| | | | |
|---|---|---|---|
| CH | 2008006234 | | 1/2008 |
| DE | 1815734 | * | 7/1969 |
| DE | 19915322 | | 1/2001 |
| DE | 19915322 C1 | * | 1/2001 |

(Continued)

OTHER PUBLICATIONS

Translation of DE 1815734.*

(Continued)

*Primary Examiner* — Lauren Crane
(74) *Attorney, Agent, or Firm* — Buchanan Nipper

(57) ABSTRACT

An apparatus for a waterless urinal is described. The apparatus comprises a housing defining a chamber for receiving a consumable de-odorizer, the housing including an access device to permit access to the chamber for allowing replacement of the consumable de-odorizer.

28 Claims, 4 Drawing Sheets

(56) References Cited

FOREIGN PATENT DOCUMENTS

| | | |
|---|---|---|
| EP | 018451 | 7/1986 |
| EP | 1785077 | 12/2005 |
| GB | 2319540 | 5/1998 |
| GB | 2423709 | 9/2006 |
| WO | 9907953 A1 | 2/1999 |

OTHER PUBLICATIONS

Translation of DE 199 15 322.*
International Search Report for PCT/GB2008/003229.
EP Office Action 94(3) dated Apr. 4, 2014.

* cited by examiner

URINAL APPARATUS

SUMMARY OF THE INVENTION

The present invention relates to an apparatus for a waterless or low water usage urinal.

BACKGROUND TO THE INVENTION

In recent years there has been a growing recognition of the cost of supplying water to, and dealing with waste water from, buildings. In some territories and/or organisations there has been a drive to reduce water consumption. A significant source of water consumption for a building, such as an office block or a shopping centre, is waste water from flushable urinals.

Water consumption can be significantly reduced in such a building if flushable urinals are replaced with "waterless" or low water usage urinals. A waterless urinal is a urinal which requires no flushing and may include a specially designed trap which utilises urine to form a liquid seal to prevent back odours from the soil stack being emitted through the urinal. Other waterless urinals may feature oil filled traps or non-return valves which do not rely on a liquid based seal.

Conventional waterless urinals include a disposable cartridge which contains a consumable de-odoriser. The de-odoriser gives off an odour which masks the smell of the urine contained within the trap. The physical size of the de-odoriser reduces through contact with air and urine, and the cartridges are replaced periodically as part of a maintenance schedule. There are problems associated with such a regime however; for example, where there is more than one urinal, the time period between cartridge changes is determined by the requirements of the urinal which is used most heavily as the consumable de-odoriser in this urinal will be consumed most quickly. In such a situation, the cartridges of other urinals in the same toilet may be replaced unnecessarily if they are changed as part of the periodic maintenance. Furthermore, when the cartridge is changed there is a significant amount of material which has to be disposed of.

SUMMARY OF THE INVENTION

According to a first aspect of the present invention there is provided an apparatus for a waterless urinal, the apparatus comprising:

a housing defining a chamber for receiving a consumable de-odoriser, the housing including an access device to permit access to the chamber for allowing replacement of the consumable de-odoriser.

Providing an apparatus which permits replacement of the consumable de-odoriser permits the apparatus to be reused once the de-odoriser has depleted. Such an arrangement may also permit a new consumable de-odoriser to be inserted on top of or besides an existing but not fully depleted consumable de-odoriser. This arrangement has the advantage that it is not necessary to wait until the consumable de-odoriser has been fully used before inserting a new de-odoriser.

The term "de-odoriser" is used to indicate any material which can be used to mask a smell from the urinal. It can also be used to refer to cleaning materials, or colouring materials.

In one embodiment, the access device comprises a first housing portion and a second housing portion, the first and second portions being connected such that moving the first portion with respect to the second portion permits access to the chamber.

Preferably, the access device permits repeated access to the chamber. Repeated access permits the apparatus to be used repeatedly.

Preferably, the first portion is movable with respect to the second portion between a closed configuration in which the chamber is closed, and an open configuration in which the chamber is accessible. By closed it is meant the apparatus is ready for use. Being able to close the chamber and, in some cases, seal the chamber, allows the consumable de-odoriser to be hidden from view.

Preferably, in the closed configuration, the first portion is adapted to be fixed relative to the second portion.

Most preferably, in the closed configuration, the first portion is adapted to be locked relative to the second portion.

The first portion may be connected to the second portion by means of a threaded connection.

In one alternative, the first portion is connected to the second portion by a bayonet type fitting.

In a further alternative, the first and second portions have an interference connection.

In a still further alternative, the first portion is connected to the second portion by a pivot connection.

Preferably, the pivot connection is a hinge, though any form of connection is suitable which permits the first and second portions to be separated sufficiently to permit access to the consumable de-odoriser chamber.

In another embodiment, the access device comprises a port permitting access to the chamber.

Preferably, the port is normally closed.

Most preferably, the port is normally closed and sealed.

Preferably, the port is opened by the application of a force.

Preferably, the port comprises a port cover.

Preferably, the port is opened by the application of a force to the port cover.

Preferably, the port cover is movable between a closed position in which the port is covered to an open position in which the port is uncovered.

Preferably, in the open position, the chamber can be accessed.

Preferably, the port cover is biased to the closed position.

Preferably, the port is adapted to be moved to the open configuration by a de-odoriser feed device.

Preferably, the feed device is an injection nozzle. Having the apparatus adapted to be fed through an injection nozzle permits the de-odoriser to be injected through, for example, a gun type arrangement which eliminates the need for the user to touch the urinal.

In one embodiment, the port cover comprises first and second doors.

The doors may be pivotally mounted to the housing.

In another embodiment, the port cover comprises a series of overlapping leaves.

In a further embodiment, the port cover defines a self-sealing access aperture.

In this further embodiment, the port cover may be polymeric.

Preferably, the apparatus further comprises a consumable level indicator.

Preferably, the consumable level indicator comprises a chamber viewing device.

Preferably, the chamber viewing device is a window defined by the housing.

In one embodiment, the port also serves as the chamber viewing device.

In one this embodiment, the port cover may be transparent.

The consumable level indicator may comprise a change of at least one of the physical dimensions of the apparatus as the consumable level decreases. For example, the apparatus height may reduce as the consumable is consumed.

Preferably, the apparatus is biased to change one or more of the dimensions of the apparatus as the consumable level decreases.

Alternatively, the apparatus is biased to move one of the first or second portions with respect to the other of the first or second portions as the consumable level decreases.

In one embodiment, the first portion rotates with respect to the second portion as the consumable decreases.

According to a second aspect of the present invention there is provided a consumable de-odoriser for a waterless urinal, the de-odoriser comprising a gel, flowable material or fluid According to a third aspect of the present invention there is provided a consumable de-odoriser for a waterless urinal, the de-odoriser comprising a pellet.

According to a fourth aspect of the present invention there is provided a consumable de-odoriser for a waterless urinal, the consumable de-odoriser comprising an indicator device for indicating consumption of the de-odoriser.

Preferably, the indicator device comprises a portion of material of different colour to the rest of the de-odoriser. Such an arrangement permits, when used with embodiments of the apparatus for a waterless urinal of the first aspect, a user to see when the consumable needs changing because of the change of colour of the consumable de-odoriser.

Alternatively the indicator device comprises a portion of material which changes to different colour to the rest of the de-odoriser on contact with urine. This arrangement also permits, when used with embodiments of the apparatus for a waterless urinal of the first aspect, a user to see when the consumable needs changing because of the change of colour of the consumable de-odoriser.

Alternatively, the indicator comprises at plurality of portions of material, at least one of the portions adapted to colour a liquid. In certain embodiments of the invention, the consumable de-odoriser can be arranged so that, in use, as the de-odoriser depletes a change in colour of a liquid contacting the consumable can be seen.

Preferably, both portions of the material are adapted to colour a liquid. In such an arrangement the selected colours can provide a significant contrast as the consumable depletes.

It will be understood that preferred or other features of the one aspect may also be applicable to one or more of the other aspects and have not been repeated for brevity.

BRIEF DESCRIPTION OF THE DRAWINGS

Embodiments of aspects of the invention will now be described with reference to the accompanying drawings in which.

DETAILED DESCRIPTION OF THE DRAWINGS

Figure 1:
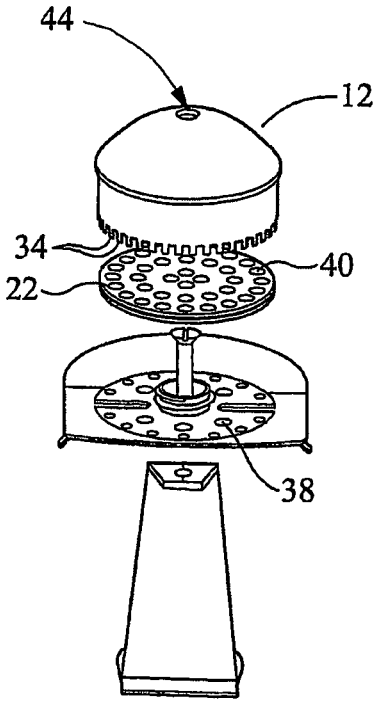
FIG. 1 is an exploded view of a urinal apparatus according to a first embodiment of the present invention.
Figure 2:
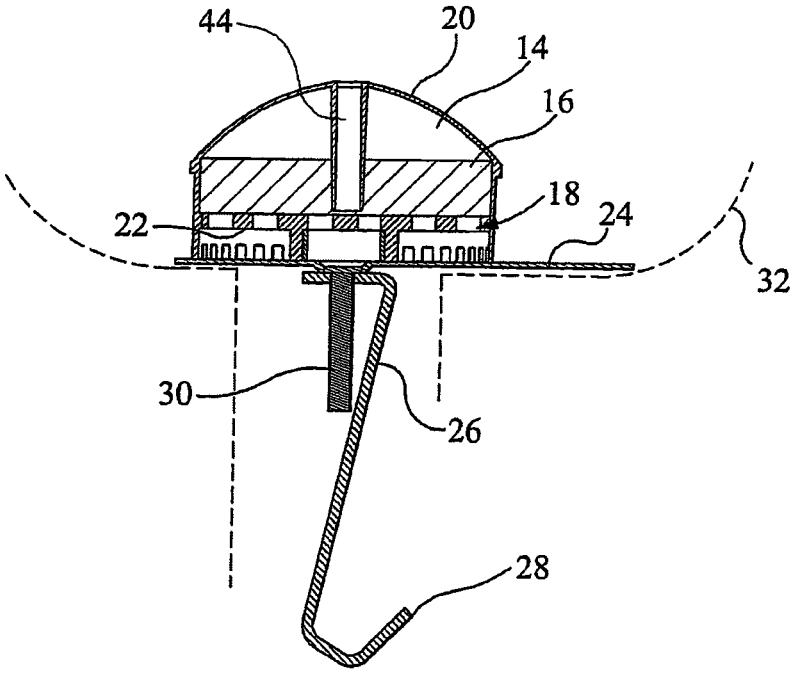
FIG. 2 is a longitudinal section through the apparatus of FIG. 1.

Reference is made to FIG. 1, an exploded view of a urinal apparatus, generally indicated by reference numeral 10, according to a first embodiment of the present invention, and FIG. 2, a longitudinal section through the apparatus of FIG. 1. The urinal apparatus 10 comprises a housing 12 defining a chamber 14 (FIG. 2) adapted to receive a consumable de-odoriser 16 in the form of a torus.

The housing 12 further includes an access device 18 in the form of a threaded connection between a first housing portion 20 and a second housing portion 22. The access device 18 permits access to the chamber 14 allowing the consumable de-odoriser 16 to be replaced, or topped up, as and when required. As can be seen most clearly from FIG. 2, the consumable de-odoriser 16 is supported by the second housing portion which is in the form of a grid. A vent passage 44 extends from generally above the chamber 14 to generally below the consumable de-odoriser 16.

The second housing portion 22 is connectable to a urinal outlet cover 24 which includes a hook shaped apparatus retainer 26, a hook portion 28 of which is adapted to releasable engage a trap (not shown) in a urinal. The retainer 26 is secured to the outlet plate 24 by a bolt 30.

In use, urine flows down the urinal walls 32 (shown in broken outline) and enters the apparatus 10 through access apertures 34 defined by the first housing portion 20. The urine exits the apparatus 10 and enters the urinal outlet 36 through holes 38 defined by the outlet plate 24. As can be seen particularly on FIG. 1, there are fewer outlet plate holes 38 than there are housing access apertures 34 resulting, if there is sufficient flow of urine, in a build up of urine on the outlet plate 24. The urine builds up beneath the consumable de-odoriser 16 and comes into contact with the consumable de-odoriser 16 through apertures 40 defined by the second housing portion 22. Contact with urine increases the release of masking odours from the de-odoriser 16 to keep the urinal and the surrounding area smelling fresh.

Figure 3:
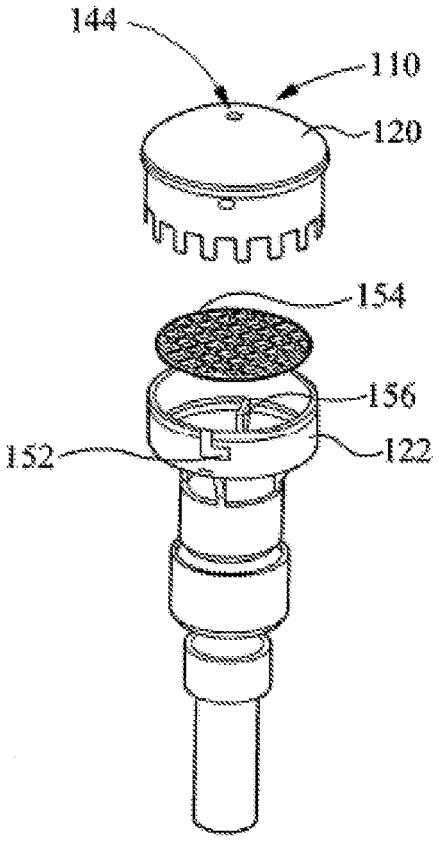
FIG. 3 is an exploded view of a urinal apparatus according to a second embodiment of the present invention.
Figure 4:
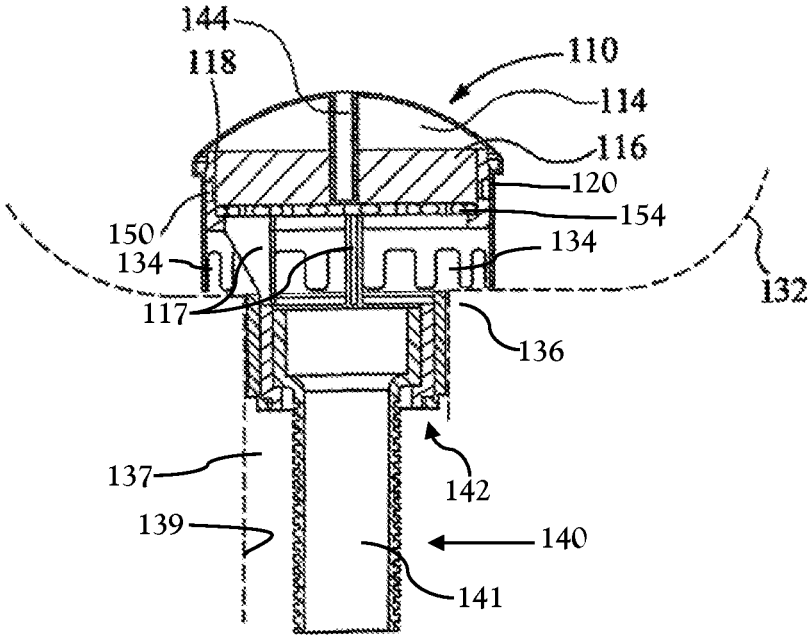
FIG. 4 is a longitudinal section through the urinal apparatus of FIG. 3 shown complete with a consumable de-odoriser.

Reference is now made to FIG. 3, an exploded view of a urinal apparatus according to a second embodiment of the present invention, and FIG. 4, a longitudinal section through the urinal apparatus of FIG. 3 shown complete with a consumable de-odoriser 116. Many of the features of the first embodiment are common to the second embodiment. These common features are referenced on the second embodiment incremented by 100. For example, a vent passage 144 extends from generally above the chamber 114 to generally below the consumable de-odoriser 116.

The access device 118 in this apparatus 110 is provided by a bayonet type fitting. A pin 150 (FIG. 4) extending inwardly from an internal surface of the first housing portion 120 engages a slot 152 (FIG. 3) defined by the second housing portion 122. To assemble the apparatus 110, the first housing portion 120 is aligned with the second housing portion 122 such that the pin 150 enters the slot 152. The apparatus 110 is then assembled by a push and twist action.

In this embodiment, the consumable de-odoriser 116 is supported by a grid 154 which is separate from the second housing portion 122. The second housing portion 122 defines a number of detentes 156 adapted to receive the de-odoriser support grid 154.

The apparatus 110 includes a urinal outlet insert 140 for insertion into the urinal outlet passageway 137 of the urinal outlet 136 so as to support the apparatus 110 from the urinal outlet 136. In use, urine flows down the urinal walls 132 (shown in broken outline) and enters the apparatus 110 through access apertures 134 defined by the first housing portion 120 and flows beneath the de-odoriser support 154. The urinal outlet insert 140 defining an insert passageway 141 for allowing the flow of urine from beneath the de-odoriser support 154 into the urinal outlet passageway 137. The urinal outlet insert 140 comprising: a urinal outlet engaging portion 142 for supporting the urinal outlet insert 140 within the urinal outlet passageway 137 by engaging the passageway surface 139, and a plurality of support members 117 extending between the housing 120 and the urinal outlet insert 140, wherein the support members 117 are spaced apart for allowing urine to enter the apparatus 110 via the at least one access aperture 134 to flow between the spaced apart support members 117, into the insert passageway 141, and subsequently into the urinal outlet passageway 137, thereby allowing the urine to drain into a plumbing system.

Figure 5:
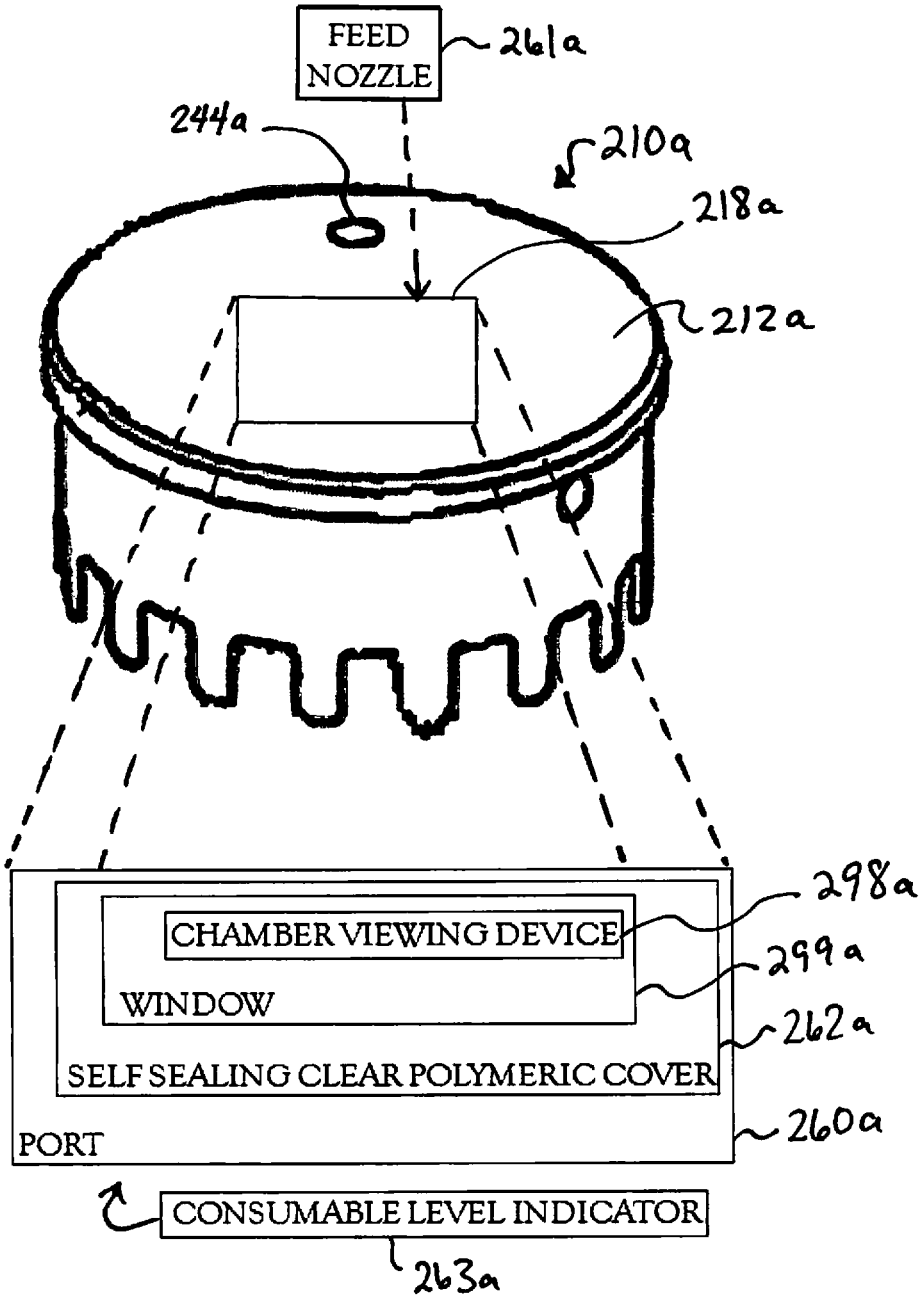
FIG. 5 is a perspective view of a first housing portion of a urinal apparatus according to a third embodiment of the present invention.

FIG. 5 is a perspective view of a first housing portion 212*a* of a urinal apparatus 210*a* according to a third embodiment of the present invention. Common features of the third embodiment to those of the first embodiment are incremented by 200*a*. For example, a vent passage 244*a* extends from generally above the chamber to generally below the consumable de-odoriser. The first portion 212*a* is suitable for use in place of the first housing portion 112 of FIGS. 3 and 4.

The first housing portion 212*a* includes an access device 218*a* in the form of a port 260*a* for providing access to the internal chamber (not shown). A port 260*a* of this type permits a consumable de-odoriser to be injected into the chamber. The consumable de-odoriser (not shown) in this case would be in the form of a thick gel or pellets. The consumable de-odoriser is dispensed through the port 260*a* by a dispenser having a feed nozzle 261*a*.

The port 260*a* is sealed by a self-sealing clear polymeric cover 262*a* which defines an access hole 264*a*. The chamber is filled by applying a pressure to the cover 262*a* by the end of the dispensing nozzle 261*a*. If sufficient pressure is applied the hole 264*a* in the polymeric cover 262*a* is forced open permitting the de-odoriser to be dispensed.

The transparent port cover 262*a* also serves as a window 299*a* into the chamber, serving as a chamber viewing device 298*a* and as a consumable level indicator 263*a* permitting the level of de-odoriser within the chamber to be assessed without having to be dismantled.

Figure 6:
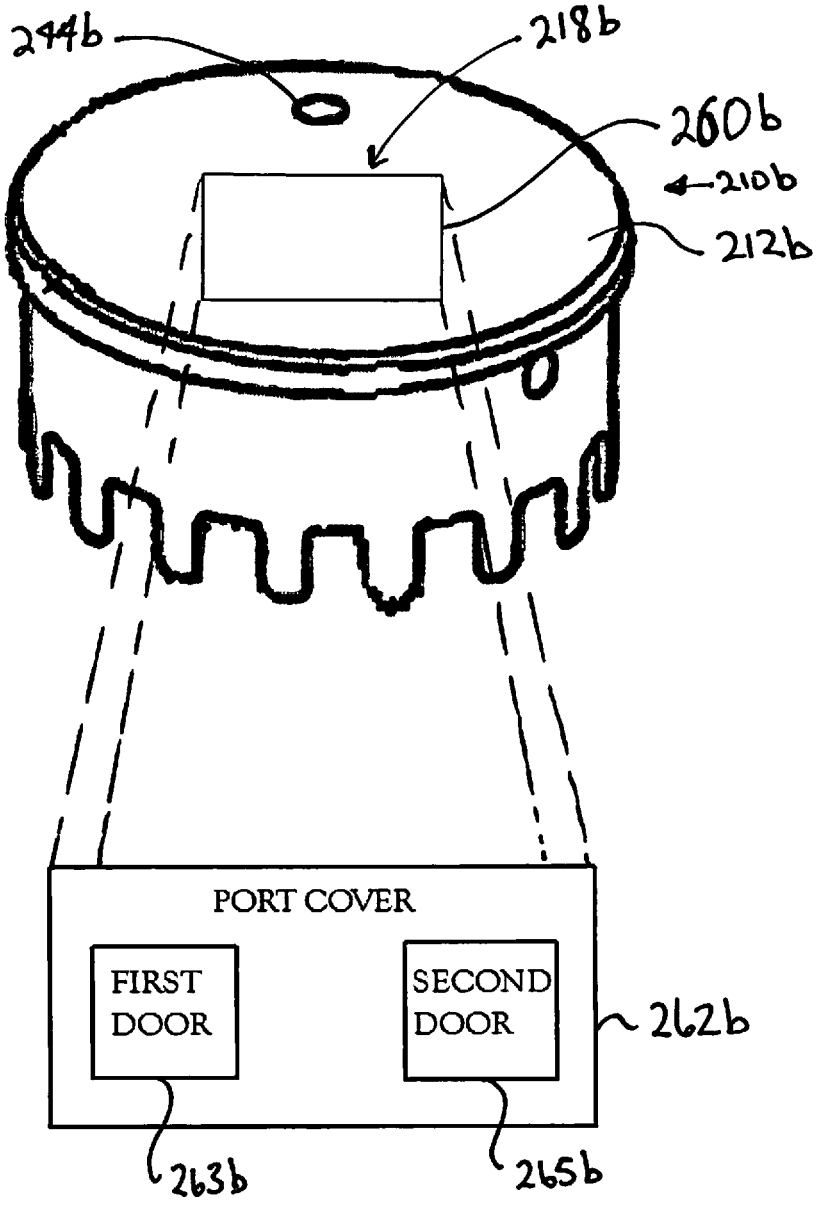
FIG. 6 is a perspective view of a first housing portion of a urinal apparatus according to a fourth embodiment of the present invention.

FIG. 6 is a perspective view of a first housing portion 212*b* of a urinal apparatus 210*b* according to a fourth embodiment of the present invention. Common features of the fourth embodiment to those of the first embodiment are incremented by 200*b*. The first portion 212*b* is suitable for use in place of the first housing portion 212*a* of FIG. 5.

The port cover 262*b* comprises first and second doors 263*b*, 265*b*. In the embodiment shown, the doors are pivotally mounted to the housing 212*b*.

Various modifications and improvements can be made to the above described embodiments without departing from the scope of the present invention. For example, although the port 260*a* is described as being part of a first housing portion, the port 260*a* could be provided in a conventional single piece apparatus which is not intended for being separated.

The invention claimed is:

1. An apparatus for a waterless urinal comprising a urinal outlet defining a urinal outlet passageway having a passageway surface, the apparatus being supportable from the urinal outlet, the apparatus comprising:

a housing defining a chamber for receiving a consumable de-odoriser, the chamber including a de-odoriser cover disposed above the consumable de-odoriser, the de-odoriser cover including a continuous outer surface for preventing fluid access to the de-odoriser from above the de-odoriser cover, the housing including an access device to permit repeated access to the chamber for allowing replacement of the consumable de-odoriser, the housing configured to permit a new consumable de-odoriser to be inserted on top of or besides an existing but not fully depleted consumable de-odoriser, and the housing defining at least one access aperture for urine to enter the apparatus laterally from a wall of the urinal;

a de-odoriser support disposed beneath the consumable de-odoriser for supporting the consumable de-odoriser, the de-odoriser support having apertures therein and the de-odoriser being accessible to urine through said apertures, the at least one access aperture defined by the housing allowing urine to enter the apparatus beneath the de-odoriser support;

a urinal outlet insert for insertion into the urinal outlet passageway so as to support the apparatus from the urinal outlet, the urinal outlet insert defining an insert passageway for allowing flow of urine from beneath the de-odoriser support into the urinal outlet passageway, the urinal outlet insert comprising: a urinal outlet engaging portion for supporting the urinal outlet insert within the urinal outlet passageway by engaging the passageway surface, and a plurality of support members extending between the housing and the urinal outlet insert, wherein the support members are spaced apart for allowing urine entering the apparatus via the at least one access aperture to flow between the spaced apart support members, into the insert passageway, and subsequently into the urinal outlet passageway; and further wherein the apparatus defines a vent tube in addition to the at least one access aperture, the vent tube extending from the de-odoriser cover to generally below the consumable de-odoriser and above the de-odoriser support such that the vent tube provides a flow path for air to pass through the apparatus past the chamber without contacting the consumable de-odoriser; and wherein the apparatus is adapted for use with a waterless urinal, whereby the chamber is arranged such that the de-odoriser is activatable by urine accessing the de-odoriser in the chamber via the apertures in the de-odoriser support without requiring any flushing water.

2. An apparatus according to claim 1, wherein the access device comprises a first housing portion and a second housing portion, the first and second portions being connected such that moving the first portion with respect to the second portion permits access to the chamber, the first portion being movable with respect to the second portion between a closed configuration in which the chamber is closed, and an open configuration in which the chamber is accessible.

3. An apparatus according to claim 2 wherein in a closed configuration the chamber sealed.

4. An apparatus according to claim 2, wherein in a closed configuration the chamber is configured such that a consumable de-odoriser is hidden from view.

5. An apparatus according to claim 2, wherein in the closed configuration, the first portion is adapted to be fixed and locked relative to the second portion.

6. An apparatus according to claim 2 wherein the first portion is connected to the second portion by means of a threaded connection, a bayonet type fitting, an interference connection, or by a hinge.

7. An apparatus according to any of the claim 1, wherein the access device comprises a port permitting access to the chamber, the port being normally closed.

8. An apparatus according to claim 7 wherein the port is normally closed and sealed.

9. An apparatus according to claim 7 wherein the port comprises a port cover, and the port is opened by the application of a force to the port cover.

10. An apparatus according to claim 9 wherein the port cover is movable between a closed position in which the port is covered to an open position in which the port is uncovered, and the chamber can be accessed.

11. An apparatus according to claim 10 wherein the port cover is biased to the closed position.

12. An apparatus according to claim 10 wherein the port is adapted to be moved to the open position by a de-odoriser feed device.

13. An apparatus according to claim 12 wherein the feed device is an injection nozzle.

14. An apparatus according to claim 9 in which the port cover comprises first and second doors pivotally mounted to the housing.

15. An apparatus according to claim 9 in which the port cover comprises a series of overlapping leaves or a polymeric self-sealing access aperture.

16. An apparatus according to claim 1 wherein the apparatus further comprises a consumable level indicator indicating a consumable level of said consumable de-odoriser in said housing.

17. An apparatus according to claim 16 wherein the consumable level indicator comprises a chamber viewing device.

18. An apparatus according to claim 17 wherein the chamber viewing device is a window defined by the housing.

19. An apparatus according to claim 17 wherein the access device comprises a port permitting access to the chamber, the port being the chamber viewing device.

20. An apparatus according to claim 19, wherein the port comprises a transparent port cover.

21. An apparatus according to claim 1, wherein the at least one access aperture is spaced from the vent tube.

22. The apparatus of claim 1, wherein the urinal outlet insert comprises: a support collar portion for supporting the plurality of support members; an outer collar portion defining the urinal outlet engaging portion for engaging the passageway surface of the urinal outlet passageway, the outer collar portion being disposed around the support collar portion; and an inner collar portion disposed within the support collar portion, the inner collar portion defining at least part of the insert passageway.

23. The apparatus of claim 22, wherein the urinal outlet insert comprises a tubular portion extending from the inner collar portion, the tubular portion defining a part of the insert passageway, wherein the inner collar portion is proximal to the housing and the tubular portion is distal from the housing.

24. The apparatus of claim 22, wherein the support collar portion and the support members define a one-piece construction.

25. The apparatus of claim 24, wherein the one-piece construction further comprises the inner collar portion and the outer collar portion.

26. The apparatus of claim 1, wherein the housing that defines the at least one access aperture is spaced from urinal outlet insert and supportable above a urinal wall of the urinal so as to allow fluid entering the apparatus to initially enter apparatus via the at least one access aperture, subsequently flow across the urinal wall beneath the de-odoriser support, and subsequently flow into the insert passageway.

27. The apparatus of claim 1, wherein the vent tube is an elongated vent tube having a width and a length, the length of the elongated vent tube being larger than the width of the elongated vent tube.

28. An apparatus for a waterless urinal comprising a urinal outlet defining a urinal outlet passageway having a passageway surface, the apparatus being supportable from a urinal outlet of the waterless urinal, the apparatus comprising:

a housing defining a chamber for receiving a consumable de-odoriser, the chamber including a de-odoriser cover disposed above the consumable de-odoriser, the de-odoriser cover including a continuous outer surface for preventing fluid access to the de-odoriser from above the de-odoriser cover, the housing including an access device to permit repeated access to the chamber for allowing replacement of the consumable de-odoriser, the housing configured to permit a new consumable de-odoriser to be inserted on top of or besides an existing but not fully depleted consumable de-odoriser, and the housing defining at least one access aperture for urine to enter the apparatus laterally from a wall of the urinal;

a de-odoriser support disposed beneath the consumable de-odoriser for supporting the consumable de-odoriser, the de-odoriser support having apertures therein and the de-odoriser being accessible to urine through said apertures, the at least one access aperture defined by the housing allowing urine to enter the apparatus beneath the de-odoriser support;

a urinal outlet insert for insertion into the urinal outlet passageway so as to support the apparatus from the urinal outlet, the urinal outlet insert defining an insert passageway for allowing flow of urine from beneath the de-odoriser support into the urinal outlet passageway, the urinal outlet insert comprising: a urinal outlet engaging portion for supporting the urinal outlet insert within the urinal outlet passageway by engaging the passageway surface of the urinal outlet passageway; and a plurality of support members extending between the housing and the urinal outlet insert, wherein the support members are spaced apart for allowing urine entering the apparatus via the at least one access aperture to flow between the spaced apart support members, into the insert passageway, and subsequently into the urinal outlet passageway, wherein the urinal outlet insert further comprises: a support collar portion for supporting the plurality of support members; an outer collar portion defining the urinal outlet engaging portion for engaging the passageway surface of the urinal outlet passageway, the outer collar portion being disposed around the support collar portion; and an inner collar portion disposed within the support collar portion, the inner collar portion defining at least part of the insert passageway, wherein the housing that defines the at least one access aperture is spaced from urinal outlet insert and supportable above a urinal wall of the urinal so as to allow fluid entering the apparatus to initially enter apparatus via the at least one access aperture, subsequently flow across the urinal wall beneath the de-odoriser support, and subsequently flow into the insert passageway; and further wherein the apparatus defines a vent tube in addition to the at least one access aperture, the vent tube extending from the de-odoriser cover to generally below the consumable de-odoriser and above the de-odoriser support such that the vent tube provides a flow path for air to pass through the apparatus past the chamber without contacting the consumable de-odoriser.

* * * * *